US007609211B2

(12) United States Patent
Hsu et al.

(10) Patent No.: US 7,609,211 B2
(45) Date of Patent: Oct. 27, 2009

(54) HIGH-DIRECTIVITY MICROSTRIP ANTENNA

(75) Inventors: Chieh-Sheng Hsu, Taipei Hsien (TW); Chang-Hsiu Huang, Taipei Hsien (TW)

(73) Assignee: Wistron Corp., Hsinchu (TW)

( * ) Notice: Subject to any disclaimer, the term of this patent is extended or adjusted under 35 U.S.C. 154(b) by 0 days.

(21) Appl. No.: 11/812,973

(22) Filed: Jun. 22, 2007

(65) Prior Publication Data

US 2008/0238782 A1 Oct. 2, 2008

(30) Foreign Application Priority Data

Apr. 2, 2007 (TW) ..... 96205320 U

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS 4,379,296 A * 4/1983 Farrar et al. ..... 343/700 MS
4,386,357 A * 5/1983 Patton ..... 343/700 MS
4,529,987 A * 7/1985 Bhartia et al. ..... 343/700 MS

* cited by examiner

*Primary Examiner*—Tho G Phan

(57) ABSTRACT

A high-directivity microstrip antenna comprising a dielectric layer with a first surface and a second surface that respectively connects to a metal patch and a ground metal layer, wherein the dielectric layer has a through-hole with a metal element connecting to the first surface and the second surface, and the metal element is positioned at the interior of the through-hole, wherein the two ends of the metal element respectively electrically connects to the metal patch and the ground metal layer for having higher directivity when the antenna is designed in a fixed dimension; also, for saving cost by selecting a dielectric layer with various coefficients.

17 Claims, 4 Drawing Sheets

| Dielectric materials | DK | Patch_R (mm) | Post_R (mm) | Total peak Dir. (dBi) |
|---|---|---|---|---|
| NY9220 | 2. 20 | 24. 9 | 1. 0 | 8. 15 |
| NY9233 | 2. 33 | 24. 7 | 2. 7 | 8. 03 |
| TLX-7 | 2. 60 | 24. 8 | 5. 2 | 8. 09 |
| NX9270 | 2. 70 | 24. 7 | 5. 6 | 8. 04 |
| RO4230 | 3. 00 | 24. 9 | 7. 1 | 8. 08 |
| RO4233 | 3. 33 | 24. 9 | 8. 3 | 8. 07 |
| Ceramic K9 | 9. 20 | 24. 9 | 15. 3 | 8. 12 |

HIGH-DIRECTIVITY MICROSTRIP ANTENNA

BACKGROUND OF THE INVENTION

1. Field of the Invention

This invention relates to a microstrip antenna, in particular, to a high-directivity antenna.

2. Description of Related Art

The TW Patent No. I223909 discloses a circular polarized micro-strip antenna with capacitance feed-in includes a substrate with opposite first and second surfaces, a feed-in port, a feed-in metal electrode, a radiate metal electrode, and a ground metal electrode. The substrate is a ceramic substrate with high dielectric constant. The feed-in metal electrode is formed on the first surface of the substrate, and the feed-in metal electrode is electrically connected with the feed-in port. The radiate metal electrode is formed on the first surface of the substrate, and surrounds the feed-in metal electrode, wherein a circular area is generated between the feed-in metal electrode and the radiate metal electrode. The ground metal electrode is formed on the second surface of the substrate having a through-hole to connect the first surface and the second surface for electrically connecting the feed-in metal electrode and the feed-in port.

The U.S. Pat. No. 6,879,292 also discloses a patch antenna which includes a dielectric substrate having a through-hole for disposing a feed pin.

Next, the U.S. Pat. No. 7,030,815 discloses an antenna patch coupling a connecting element through a plated through-hole of a dielectric layer.

In general, the cost for the microwave plate with low dielectric coefficient is rather high, such as Teflon plate; whereas the cost for microwave plate with high dielectric coefficient is much lower, such as the Ro4003 plate or the ceramic plate. For the conventional microstrip antenna, the larger the dimension is, the higher directivity an antenna has when using the substrate with lower dielectric coefficient. Whereas, the smaller the dimension is, the lower directivity an antenna has when using the substrate with higher dielectric coefficient.

Bearing in mind the problems and deficiencies of the prior art, it is therefore an object of the present invention to provide a high-directivity microstrip antenna having higher directivity when the antenna is designed in a fixed dimension.

It is another object of the present invention is to provide a high-directivity microstrip antenna with lower manufacturing cost.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to a high-directivity microstrip antenna for having higher directivity and with lower cost comprises a dielectric layer having the first and second surfaces that opposite to each other, a metal patch connecting to the first surface for receiving a radiate electromagnetic wave, a ground metal layer connecting to the second surface for grounding, wherein the dielectric layer has a through-hole with a metal element connecting to the first surface and the second surface, and the metal element is positioned into the interior of the through-hole, wherein the two ends of the metal element with electricity respectively connect to the metal patch and the ground metal layer. When the antenna is designed in a fixed dimension, the antenna has higher directivity and with lower cost by selecting a dielectric layer with various dielectric coefficients.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The invention can be better understood with reference to the following drawings. The components in the drawings are not necessary drawn to scale, emphasis instead being placed upon clearly illustrating the principles of the present invention. In the drawings, like reference numerals designate corresponding parts throughout the several views.

DETAILED DESCRIPTION OF THE INVENTION

Figure 1:
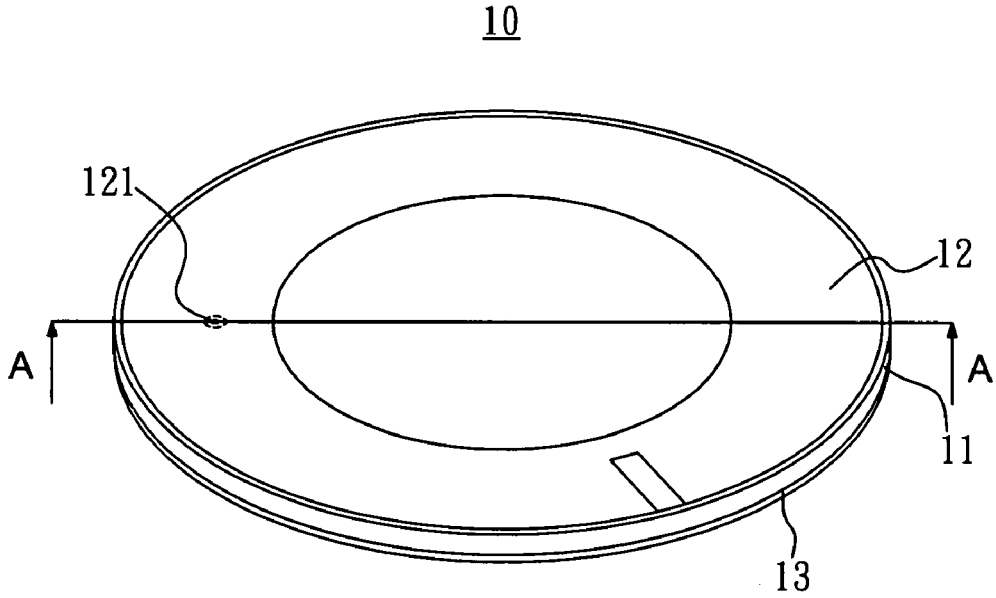
FIG. 1 is an explanatory view of the overall structure of the first embodiment in accordance with the present invention.
Figure 2:
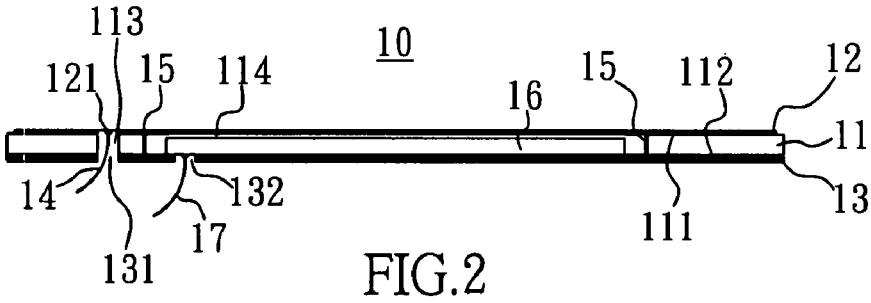
FIG. 2 is a section view taken along lines A-A of the first embodiment shown in FIG. 1.

Referring to FIG. 1 and FIG. 2, a high-directivity microstrip antenna in accordance with the present invention has higher directivity and with lower cost when the antenna is designed in a fixed dimension. The high-directivity microstrip antenna 10 of the first embodiment according to the present invention comprises a dielectric layer 11 with a first surface 111 and the second surface 112 that opposite to each other, a metal patch 12 connecting to the first surface 111 for receiving a radiating electromagnetic wave, a ground metal layer 13 connecting to the second surface 112 for grounding. The metal patch 12 includes a feeding point 121 which electrically connects to a conductive line 14. The dielectric layer 11 and the ground metal layer 13 opposite to a feeding point 121 respectively has a first through-hole 113 and a second through-hole 131 for disposing the conductive line 14 extending to the exterior of the ground metal layer 13.

The present invention is characterized as that the dielectric layer 11 has a through-hole 114 connecting to the first surface 111 and the second surface 112, and the metal element 15 is positioned into the interior of a through-hole 113, such as a metal foil plating the interior wall of the through-hole. The two ends of a metal element 15 electrically connects to the metal patch 12 and the ground metal layer 13 respectively which enable the conjunctions on metal patch 12 and ground metal layer 13 in electric condition. Further an electronic element 16 such as a chipset can be positioned in the through-hole 114 when the dimension of the through-hole 114 is big enough. In addition, the ground metal layer 13 has a third through-hole 132 opposite to the through-hole 114. The aperture of the third through-hole 132 is the same as the aperture of the through-hole 114 for disposing the conductive line 17 of the electronic element 16 extending to the exterior of the ground metal layer 13.

Figure 3:
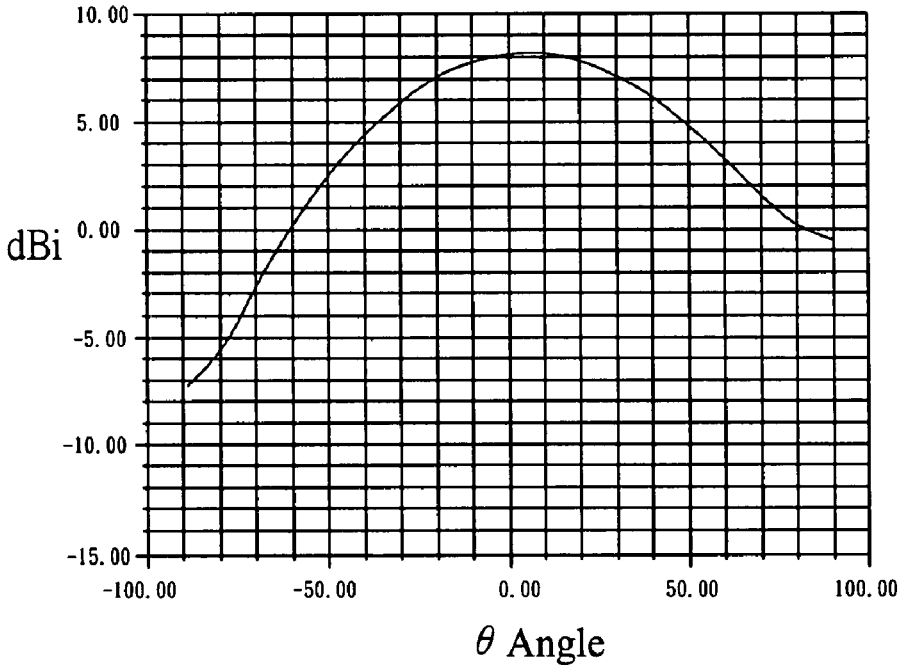
FIG. 3 is a plot of total directivity analysis for the microstrip antenna of the first embodiment in accordance with the present invention.

In order to prove the microstrip antenna 10 having higher directivity in accordance with the present invention, one simulation software (known as HFSS by Ansoft Cororation) is adopted in the present invention for conducting the simulation analysis. When using the circle ceramic plate as the dielectric layer with the dielectric coefficient at 9.2, the radius of 25.5 mm, the thickness of 3 mm; also, the radius of the through-hole is 15.42 mm. In addition, the metal patch is formed in circle with radius of 24.9 mm; and the ground metal layer is formed in circle with radius of 25.5 mm. Assuming that the described dielectric layer with circle metal patch and circle ground metal layer connects to the roof of an automobile where the dimension of the ground metal is approximately being infinitely large, the total peak directivity achieve 8 dBi at 0 degree as shown in FIG. 3.

Figure 4:
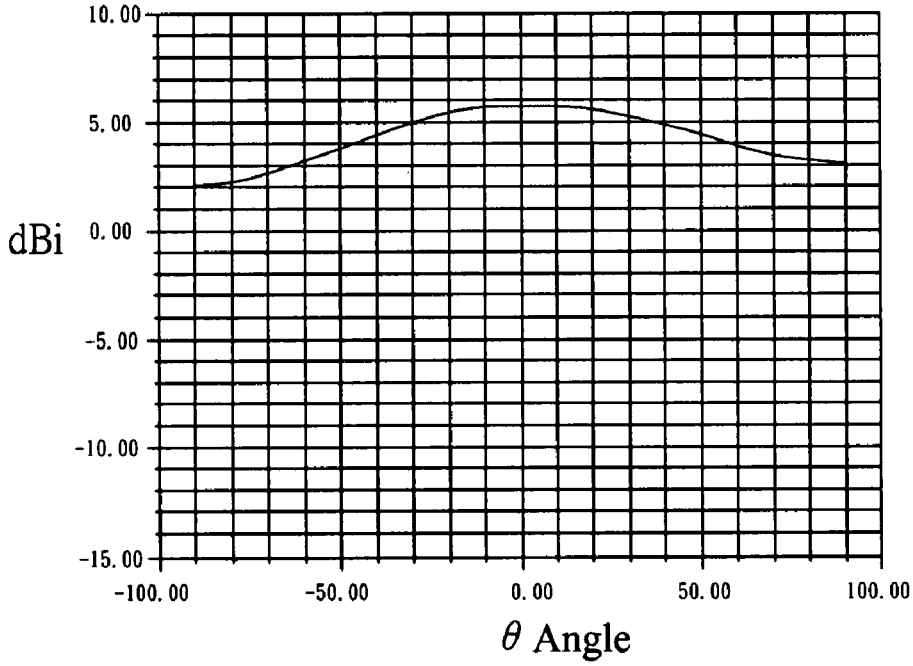
FIG. 4 is a plot of total directivity analysis for the prior antennas in responsive to the first embodiment in accordance with the present invention.

On the other hand, assuming that a conventional antenna structure with the same dielectric material and the same dimension of a ceramic plate, but without a through-hole and a metal element, employs the same dimension of a ground metal layer connecting to the roof of an automobile where the dimension of the ground metal is approximately being infinitely large. In order to have the resonating frequency closest to the high-directivity microstrip antenna in accordance with the present invention for a comparing conventional antenna structure, a metal patch with the radius of 12.09 mm is adopted for conducting the simulation analysis which results in the total peak directivity of 5.8 dBi at 0 degree as shown in FIG. 4. Therefore, the microstrip antenna in accordance with the present invention has higher directivity than the conventional antenna upon the results of the total peak directivity through the simulation analysis of the high frequency simulation software.

Figures 5, 6:
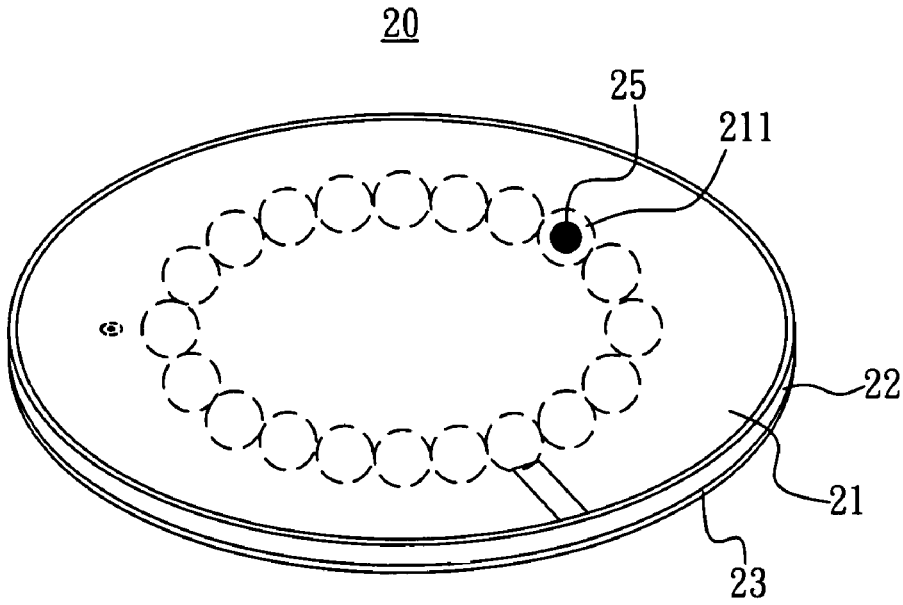
FIG. 5 is a table of total directivity analysis for a variety of microstrip antennas in accordance with the present invention.
FIG. 6 is an explanatory view of the overall structure of the second embodiment in accordance with the present invention.

Referring to FIG. 5, a variety of dielectric materials with various dielectric coefficients (DK) between 2.2 and 9.2 are further applied shown as in FIG. 5 which is a table of total directivity analysis for a variety of microstrip antennas in accordance with the present invention. Different dielectric materials have different through-holes of radius (Post_R) between 1.0 mm and 15.3 mm. The larger the dielectric coefficient of the dielectric material is, the larger the radius of the through-hole is, which also corresponding to the same radius (set at approximate 24.9 mm, Patch_R) of the metal patch and the ground metal layer. Further, assuming to dispose the metal material layer upon the infinitely large metal surface for simulation analysis, the result shows the total peak directivity (Total peak Dir.) at 8.0 dBi. According to aforementioned result, it shows that with proper adjustment on the through-hole aperture and the dimension of the metal patch, the antenna can generate the same directivity value even with different dielectric layer of different dielectric coefficient.

Referring to FIG. 1 and FIG. 6, a microstrip antenna 20 of the second embodiment in accordance with the present invention comprises a dielectric layer 21 having the opposite first and second surfaces which respectively connects to the metal patch 22 and the ground metal layer 23, which the microstrip antenna structure is nearly the same as the microstrip antenna 10 of the first embodiment. The dielectric layer 21 of the microstrip antenna 20 has a plurality of through-holes 211 arrayed in a circle. The interior of the through-holes 211 is respectively disposed a solid metal element 25 such as a solid metal pillar. The two ends of the metal element 25 respectively electrically connect to the dielectric layer 21 and the ground metal layer 23 which results in the same effect as the first embodiment. Further, the metal element 25 is a hollow ring or a metal foil connecting to the interior wall of through-hole 211.

Figure 7:
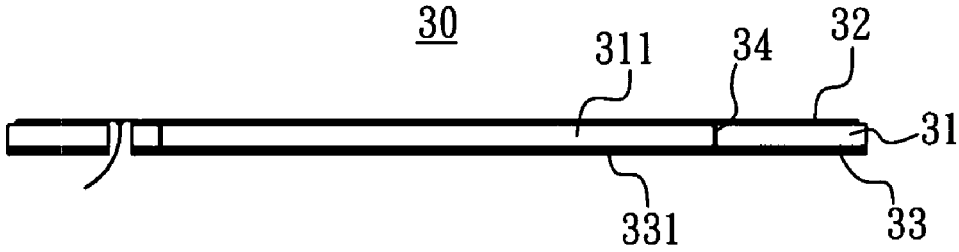
FIG. 7 is a section view of the third embodiment in accordance with the present invention.

Referring to FIG. 1 and FIG. 7, a microstrip antenna 30 of the third embodiment in accordance with the present invention comprises a dielectric layer 31 having the opposite first and second surfaces which respectively connects to a metal patch 32 and a ground metal layer 33, which the microstrip antenna structure is nearly the same as the microstrip antenna 10 of the first embodiment. The dielectric layer 31 has a through-hole 311 with a metal element 34. The metal patch 32 and the ground metal layer 33 of the microstrip antenna 30 respectively seals the two ends of the through-hole 311 which results in the same effect as the first embodiment.

Figure 8:
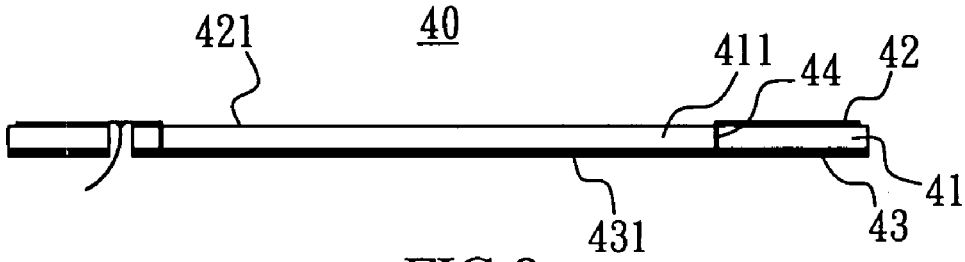
FIG. 8 is a section view of the fourth embodiment in accordance with the present invention.

Referring to FIG. 1 and FIG. 8, a microstrip antenna 40 of the fourth embodiment in accordance with the present invention comprises a dielectric layer 41 having the opposite first and second surfaces which respectively connects a metal patch 42 and a ground metal layer 43, which the microstrip antenna structure is nearly same as the microstrip antenna 10 of the first embodiment. The dielectric layer 41 has a through-hole 411 with a metal element 44. A metal patch 42 of the microstrip antenna 40 has an aperture 421 connecting to the through-hole 411 which results in the same effect as the first embodiment.

Figure 9:
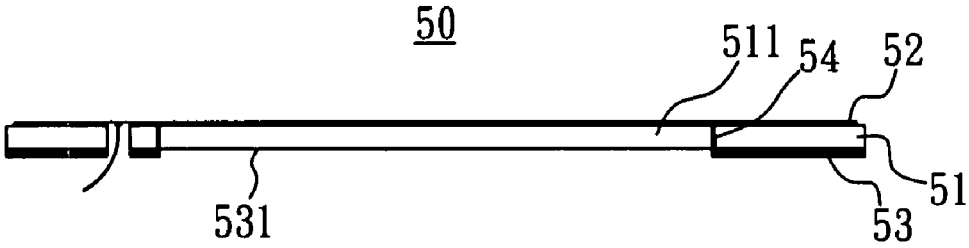
FIG. 9 is a sectional view of the fifth embodiment in accordance with the present invention.

Referring to FIG. 1 and FIG. 9, a microstrip antenna 50 of the fifth embodiment in accordance with the present invention comprises a dielectric layer 51 having the opposite first and second surfaces which respectively connects to a metal patch 52 and a ground metal layer 53, which the microstrip antenna structure is nearly the same as the microstrip antenna 10 of the first embodiment. The dielectric layer 51 has a through-hole 511 with a metal element 54. The ground metal layer 53 of the antenna 50 has an aperture 531 connecting to the through-hole 511 which results in the same effect as the first embodiment.

Figure 10:
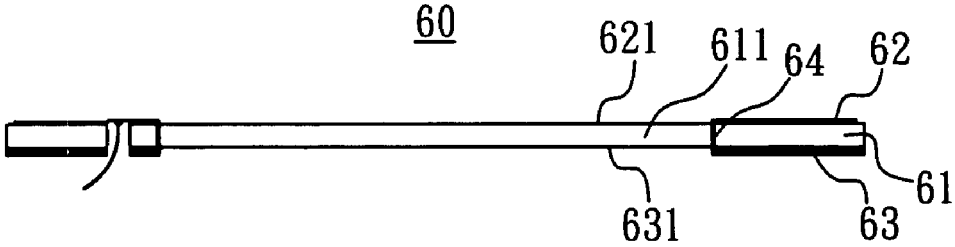
FIG. 10 is a sectional view of the sixth embodiment in accordance with the present invention.

Referring to FIG. 1 and FIG. 10, a microstrip antenna 60 of the sixth embodiment in accordance with the present invention comprises a dielectric layer 61 having the opposite first and second surfaces which respectively connects to a metal patch 62 and a ground metal layer 63, which the microstrip antenna structure is nearly the same as the microstrip antenna 10 of the first embodiment. The dielectric layer 61 has a through-hole 611 with a metal element 64. The metal patch 62 and the ground metal layer 63 of the microstrip antenna 60 respectively has the apertures 621, 631 connecting to the through-hole 611 which results in the same effect as the first embodiment. The present invention is characterized as that a dielectric layer has a through-hole with a metal element connecting between a metal patch and a ground metal layer of a microstrip antenna. The metal element is positioned into the interior of the through-hole. The two ends of the metal element respectively electrically connects the metal patch and the ground metal layer, wherein the metal element is a hollow ring, a solid pillar or a metal foil connecting to the interior wall of the through-hole. Further, the dielectric layer, the metal patch, the ground metal layer and the through-hole of the dielectric layer according to the present invention can be formed in circular, rectangular, oblong or even in random shape.

The microstrip antenna in accordance with the present invention has advantages as follows, 1. The dielectric layer can be a plate with any dielectric coefficient, such as microwave plate, generic printed circuit board, or ceramic dielectric plate, PE plate, PP plate and so on.
2. The microstrip antenna has the highest directivity when the microstrip antenna is designed in a fixed dimension.
3. In order to reduce the cost, a dielectric plate with cheaper price and higher dielectric coefficient is selected for antenna design.
4. A ceramic material with higher coefficient can be adopted as dielectric layer to break the limitation of lower directivity.
5. The flexibility is designed for the microstrip antenna in accordance with the present invention which results in the fact that the microstrip antenna can easily control the antenna radiation.
6. The dimension of the through-hole of the dielectric layer can be randomly changed.
7. The through-hole of the dielectric layer can be a solid metal pillar, a hollow metal ring or even be replaced by a plurality of small through-holes arrayed in a circle.
8. The hollow through-hole can be enlarged for positioning the electronic elements.

While the present invention has been particularly described, in conjunction with a specific preferred embodiment, it is evident that many alternatives, modifications and variations will be apparent to those skilled in the art in light of foregoing description. It is therefore contemplated that the appended claims will embrace any such alternatives, modifications and variations as falling within the true scope and spirit of the present invention.

What is claimed is:

1. A high-directivity microstrip antenna for having higher directivity and with lower cost, comprising:

a dielectric layer having the opposite first and second surfaces;

a metal patch connecting to the first surface for receiving radiate electromagnetic waves;

a ground metal layer connecting to the second surface for grounding;

wherein the dielectric layer has a plurality of through-holes arrayed in a circle, each through-hole having a metal element connecting to the first surface and the second surface, and said metal element positioned into the interior of each of the through-holes has two ends that respectively electrically connects to the metal patch and the ground metal layer, wherein the dielectric layer and the metal patch are both formed to be circular.

2. The high-directivity microstrip antenna of claim 1, wherein the metal element is a hollow ring, a solid pillar or a metal foil connecting to the interior wall of the through-hole.

3. The high-directivity microstrip antenna of claim 2, wherein the metal patch has an aperture connecting to the through-hole.

4. The high-directivity microstrip antenna of claim 3, wherein the through-hole of the dielectric layer has an electronic element.

5. The high-directivity microstrip antenna of claim 4, wherein the metal patch includes a feeding point electrically connecting to a conductive line, and wherein the dielectric layer and the ground metal layer respectively has a first through-hole and a second through-hole for disposing the conductive line extending to the exterior of the ground metal layer.

6. The high-directivity microstrip antenna of claim 3, wherein the metal patch includes a feeding point electrically connecting to a conductive line, and wherein the dielectric layer and the ground metal layer respectively has a first through-hole and a second through-hole for disposing the conductive line extending to the exterior of the ground metal layer.

7. The high-directivity microstrip antenna of claim 2, wherein the ground metal layer has a third through-hole opposite to the through-hole.

8. The high-directivity microstrip antenna of claim 7, wherein the through-hole of dielectric layer has an electronic element.

9. The high-directivity microstrip antenna of claim 8, wherein the metal patch includes a feeding point electrically connecting to a conductive line, and wherein the dielectric layer and the ground metal layer respectively has a first through-hole and a second through-hole for disposing the conductive line extending to the exterior of the ground metal layer.

10. The high-directivity microstrip antenna of claim 7 wherein the metal patch has an aperture connecting to the through-hole.

11. The high-directivity microstrip antenna of claim 10, wherein the metal patch includes a feeding point electrically connecting to a conductive line, and wherein the dielectric layer and the ground metal layer respectively has a first through-hole and a second through-hole for disposing the conductive line extending to the exterior of the ground metal layer.

12. The high-directivity microstrip antenna of claim 7, wherein the metal patch includes a feeding point electrically connecting to a conductive line, and wherein the dielectric layer and the ground metal layer respectively has a first through-hole and a second through-hole for disposing the conductive line extending to the exterior of the ground metal layer.

13. The high-directivity microstrip antenna of claim 2 wherein the metal patch and the ground metal layer respectively seals the two ends of the through-hole.

14. The high-directivity microstrip antenna of claim 13, wherein the metal patch includes a feeding point electrically connecting to a conductive line, and wherein the dielectric layer and the ground metal layer respectively has a first through-hole and a second through-hole for disposing the conductive line extending to the exterior of the ground metal layer.

15. The high-directivity microstrip antenna of claim 2, wherein the metal patch includes a feeding point electrically connecting to a conductive line, and wherein the dielectric layer and the ground metal layer respectively has a first through-hole and a second through-hole for disposing the conductive line extending to the exterior of the ground metal layer.

16. The high-directivity microstrip antenna of claim 1, wherein the metal patch includes a feeding point electrically connecting to a conductive line, and wherein the dielectric layer and the ground metal layer respectively has a first through-hole and a second through-hole for disposing the conductive line extending to the exterior of the ground metal layer.

17. The high-directivity microstrip antenna of claim 1, wherein the metal patch includes a feeding point electrically connecting to a conductive line, and wherein the dielectric layer and the ground metal layer respectively has a first through-hole and a second through-hole for disposing the conductive line extending to the exterior of the ground metal layer.

* * * * *

UNITED STATES PATENT AND TRADEMARK OFFICE

CERTIFICATE OF CORRECTION

PATENT NO. : 7,609,211 B2
APPLICATION NO. : 11/812973
DATED : October 27, 2009
INVENTOR(S) : Chieh-Sheng Hsu et al.

It is certified that error appears in the above-identified patent and that said Letters Patent is hereby corrected as shown below:

Title Page, Item [73] should read Assignee: WISTRON NEWEB CORPORATION

Signed and Sealed this
Seventeenth Day of May, 2011

David J. Kappos

David J. Kappos
*Director of the United States Patent and Trademark Office*